United States Patent [19]

Owens

[11] Patent Number: 4,629,100

[45] Date of Patent: Dec. 16, 1986

[54] APPARATUS FOR TYING BOWS

[76] Inventor: Betty Owens, 3867 Gumtree Road, Winston-Salem, N.C. 27107

[21] Appl. No.: 797,822

[22] Filed: Nov. 14, 1985

[51] Int. Cl.[4] ..... A41H 43/00; D04D 7/10

[52] U.S. Cl. ..... 223/46

[58] Field of Search ..... 28/147, 149, 151, 152, 28/150; 223/46, 106, 107, 108, 109 R; 289/17, 18.1; 248/450, 451, 447, 461; 428/4, 5

[56] References Cited

U.S. PATENT DOCUMENTS

| | | | |
|---|---|---|---|
| 1,058,348 | 4/1913 | Blumenthal | 40/152.1 |
| 1,188,452 | 6/1916 | Johnson | 248/450 |
| 2,222,413 | 11/1940 | Korenchan | 223/109 R X |
| 2,542,222 | 2/1951 | Welch | 223/46 |
| 2,666,249 | 1/1954 | Ruiz et al. | 223/46 X |
| 3,253,282 | 5/1966 | Seham | 28/150 X |
| 3,377,674 | 4/1968 | Brassaw et al. | 28/147 |
| 3,501,070 | 3/1970 | Shattuck | 223/46 |
| 3,530,558 | 9/1970 | Gick | 28/150 |
| 4,202,569 | 5/1980 | Thuringer | 28/149 X |
| 4,275,515 | 6/1981 | Hinson | 289/18.1 |
| 4,454,968 | 6/1984 | St Lawrence | 223/46 |
| 4,528,217 | 7/1985 | Spathis et al. | 223/46 X |
| 4,531,642 | 7/1985 | Racich | 248/451 X |

*Primary Examiner*—Robert R. Mackey

[57] ABSTRACT

An apparatus for winding ribbon-like material into decorative bows comprises a base member having a plurality of apertures adapted to receive a plurality of spaced pegs around which the ribbon is wound in a desired pattern. A first plurality of apertures is sized to receive pegs of one diameter, and is arranged in a row along one side of the base member. A second plurality of apertures is sized to receive pegs of a smaller diameter and this second plurality is arranged in multiple rows in a grouping spaced a prescribed distance laterally from the first plurality of apertures. Ribbon is wound around various combinations of large and/or small pegs to make bows in a variety of sizes. Areas of cork material are laminated to at least one side of the base for receiving an anchor means used to hold one end of the ribbon strand in place during winding. In an alternative embodiment the base is mounted on a folding, easel-like stand which supports the base in an upright position when desired for working with large ribbons.

4 Claims, 2 Drawing Figures

APPARATUS FOR TYING BOWS

BACKGROUND AND SUMMARY OF THE PRESENT INVENTION

Some attempts have been made to develop an apparatus for winding and tying ribbon into bows of various sizes and designs. In recent years commercially tied bows have become popular, and devices for tying such bows are used in floral shops, gift shops, etc., and on a smaller scale are used in homes for making bows for gift wrap. Examples of such devices are shown in U.S. Pat. Nos. 3,377,674; 4,454,968; and 3,044,670. U.S. Pat. No. 3,377,674 is designed primarily for making tassels and pompoms, and U.S. Pat. No. 3,044,670 is primarily designed for making small bows for gift wrapping in a non-commercial environment. Neither of these devices offers the structure capable of attaining the level of versatility necessary in a commercial establishment. The device shown in U.S. Pat. No. 4,454,968 teaches a relatively complex device having a plurality of movable spindles. However, the spindles are in a relatively fixed formation of two groups and are movable generally in groups toward and away from each other. Therefore, the versatility of that device is limited and, further, the mechanical structure is expensive to produce.

On the other hand, the present invention offers total versatility in use and economy in production for both commercial and non-commercial environments. The present invention is a device for making bows in a variety of sizes and shapes with speed and efficiency. The device is comprised essentially of a base member and a plurality of large and small pegs which are movable to various fixed positions in a plurality of apertures on the base member according to a variety of bow designs and sizes. To further increase the efficiency and versatility, the base member may be supported on an easel-like stand for working larger bows in an upright position. An area of cork-like material is laminated along at least one side edge of the base member to receive an anchor means for holding the end(s) of the ribbon strand in place during winding and tying.

The wide versatility of arrangements of the pegs in the apertures on the base member is achieved by the pattern of apertures and utilization of both small and large pegs. The arrangement of apertures and pegs will be explained in detail below. Use of the large pegs improves the finished appearance of bows formed from wide strands of ribbon because of the increased radius of curvature of the larger pegs. Further, the ribbon may be wrapped around a combination of large and small pegs, placed varying distances apart, to form bows which have loops of differing length and curvature.

It was a primary objective of the present invention to provide an improved apparatus for tying bows which would be more efficient in making a variety of bows, and one which would be more economical to produce for both commercial and non-commercial environments. Other and further objectives and modifications will become apparent when the following detailed description is studied in conjunction with the accompanying drawings.

In the drawings:

FIG. 1 is a perspective view of a preferred embodiment of the present invention; and FIG. 2 is a perspective view of an alternate preferred embodiment of the present invention.

DETAILED DESCRIPTION OF THE PRESENT INVENTION

Figure 1:
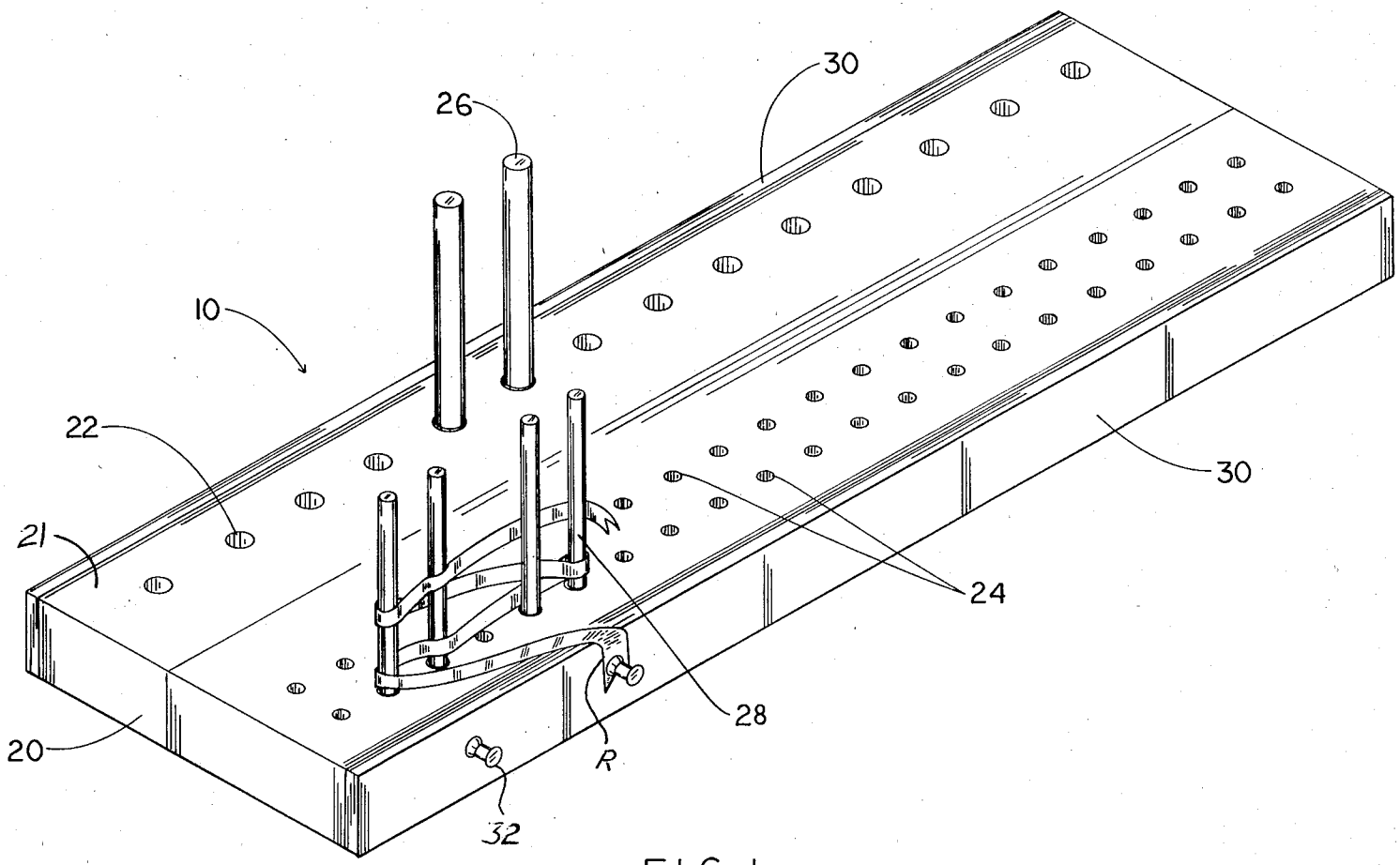

Looking first at FIG. 1, the basic unit is illustrated, wherein the apparatus 10 essentially includes a base member 20 having a top surface 21, and bottom and side surfaces. The base 20 is a substantially rectangular board-like member formed from wood, plastic or any other rigid material which can be drilled.

A dual plurality of apertures are drilled into the top or facial surface 21 for receiving perpendicular pegs around which the ribbon strands are wound. The pegs are merely inserted or removed from the apertures as desired. The first plurality of apertures 22 are of a diameter to receive a first plurality of larger pegs 26. As shown, the apertures 22 comprise one row along one long edge of the base 20, with the individual apertures spaced approximately one-half to one inch apart. This spacing can of course be varied.

The second plurality of apertures 24 are of a diameter to receive a second plurality of smaller pegs 28. The apertures 24, comprise at least one row, but preferably two or more rows along the long edge of base 20 opposite apertures 22. Within the rows, the smaller apertures 24 are spaced approximately one-half to one inch apart.

Ribbon R is wrapped around selected ones of pegs 26 or 28 according to the size and shape of the desired finished bow. If making small bows, it may be wrapped around the smaller pegs 28 as illustrated in FIG. 1. As shown, the ribbon is being wrapped in a figure-8 pattern around two pegs 28 which are approximately three to four inches apart. The method of wrapping may be varied in an almost infinite number of ways.

Figure 2:
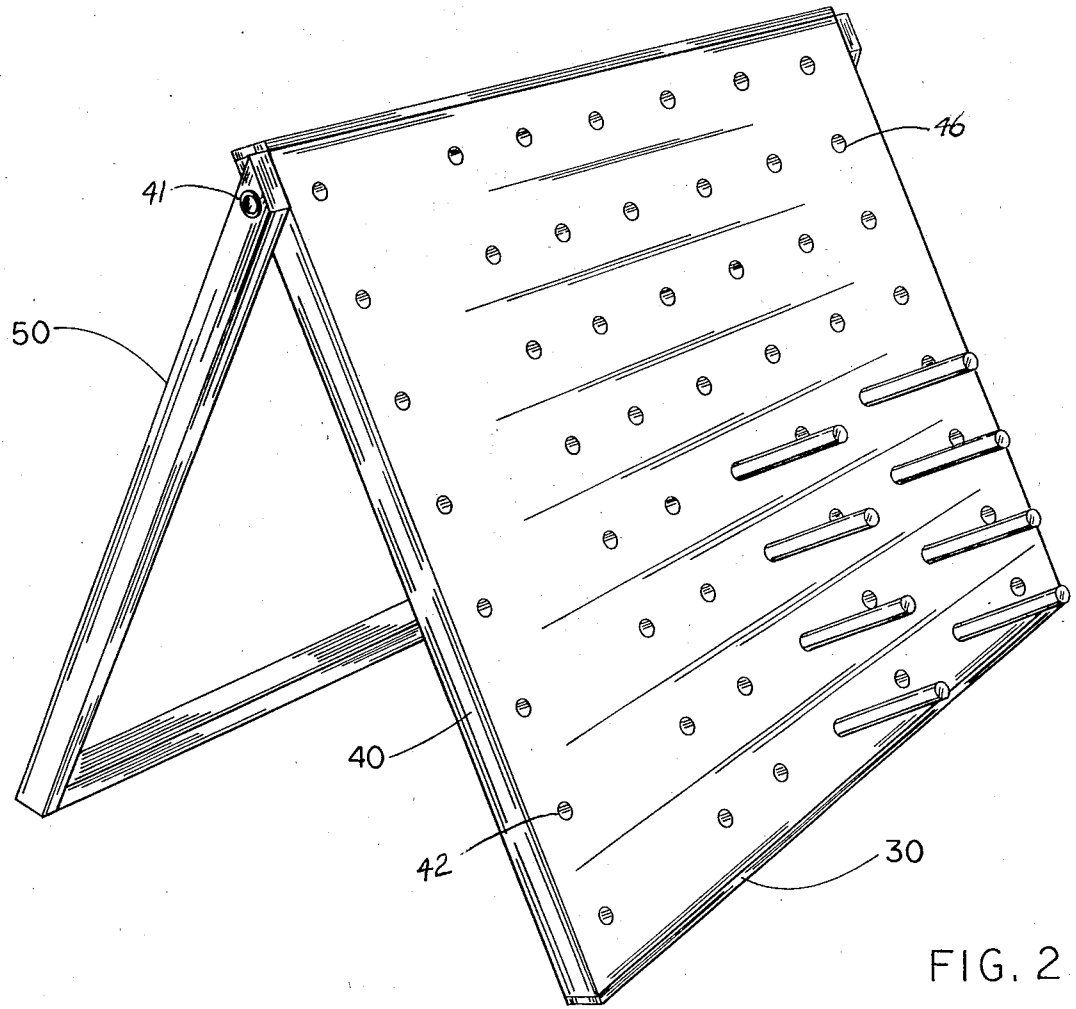

Looking next at FIG. 2, there is a somewhat larger model of the apparatus 10, designed to perhaps be preferable to commercial establishments, but certainly useful in a home or other environment. The base member 20 is supported on an easel-like stand 40 for use in working in an upright position. Such an upright position is more efficient when making large bows and working with wide ribbons. The support is comprised of a bracket pivotally attached (by any conventional means) at pivot means 41 to the upper side corners of the base. The bracket pivots away from the base and forms a support member as shown in FIG. 2. When not in use, the bracket pivots to a position wherein the bracket legs surround the base member and overlie the side edges thereof. This permits the base member to set flush on a table or support for use in a non-upright position as the embodiment of FIG. 1.

The arrangement of apertures varies in the larger embodiment. As shown, a first plurality of apertures 42 are positioned in spaced relationship along one side edge of the base member. Laterally spaced therefrom, approximately three inches away, is a second plurality of apertures 46. This second plurality is formed of rows arranged such that the apertures are spaced approximately one-half inch apart. The number of rows is matter of design choice but will preferably number about six. The apertures 42 and 46 may be the same diameter, or apertures 42 may be larger to accomodate larger pegs as previously described. Use of the alternate embodiment is as described for the model in FIG. 1 except for the stand.

The cork material 30 is also included in this embodiment as shown. The anchor means used for holding a ribbon end in place comprises a pin 32 or similar tack device such as shown in FIG. 1.

Thus described it is clear that a unique and novel apparatus for making bows of all sizes is provided. Other and further modifications are anticipated while remaining within the scope of the claims below.

What I claim is:

1. An apparatus for making bows and similar ornamental objects from continuous lengths of ribbon-like material; said apparatus comprising:

(a) a base member having at least a top surface, and side walls;

(b) said top surface including a first plurality of apertures arranged in a prescribed pattern adjacent one edge thereof, and a second plurality of apertures arranged in a prescribed pattern adjacent the opposite edge thereof;

(c) said first plurality of apertures being of a first prescribed diameter, and said second plurality of apertures being of a second, smaller diameter;

(d) a first plurality of pegs having a diameter such that said pegs will removably fit in said first apertures, and a second plurality of pegs having a diameter such that said pegs will removably fit in said second apertures;

(e) said first and second plurality of pegs being positioned in selected ones of said first and second pluralities of apertures according to a prescribed pattern for making a desired bow;

(f) a strip of cork material extending the length of and adjacent one side wall of the base member; and (g) anchor means releasably associated with said cork strip for holding at least one end of said ribbon material in place while the ribbon is being wound around said pegs; wherein the ribbon material is wound around two or more of said pegs a desired number of times before being tied off and removed to be arranged into a bow and whereby the differing diameter pegs permit variation in bow curvature when processing ribbons of varying width.

2. An apparatus according to claim 1 wherein said anchor means comprises:

tack means for insertion through said ribbon end and into said cork material to anchor the ribbon end.

3. An apparatus according to claim 1 and further including support means for supporting said base member in a substantially upright position.

4. An apparatus according to claim 3 wherein said support means comprises a bracket means pivotally attached to said base member and movable from a first position wherein said bracket surrounds said base member, overlying said side surfaces of said base member, to a second position pivoted outwardly from said base to form a supporting means therefor.

* * * * *